US006634156B1

(12) United States Patent
Rutledge

(10) Patent No.: US 6,634,156 B1
(45) Date of Patent: Oct. 21, 2003

(54) PACKAGE AND METHOD OF PACKAGING DANGEROUS GOODS FOR TRANSPORT

(76) Inventor: Arthur G. Rutledge, 10807 182 Street, Edmonton, Alberta (CA), T5S 1J5

( * ) Notice: Subject to any disclaimer, the term of this patent is extended or adjusted under 35 U.S.C. 154(b) by 0 days.

(21) Appl. No.: 09/657,851

(22) Filed: Sep. 8, 2000

(51) Int. Cl.[7] ..... B65B 11/58; B65B 23/00
(52) U.S. Cl. ..... 53/449; 53/472; 206/583
(58) Field of Search ..... 53/499, 472, 467, 53/474; 206/583, 591, 594

(56) References Cited

U.S. PATENT DOCUMENTS 2,897,641 A * 8/1959 Simon et al. ..... 53/449
4,862,674 A * 9/1989 Lejondahl et al. ..... 53/399
4,969,312 A * 11/1990 Pivert et al. ..... 53/449
5,695,090 A * 12/1997 Burdick ..... 206/521
5,881,536 A * 3/1999 Muller-Wille et al. ..... 53/425
6,067,779 A * 5/2000 Weder ..... 206/584
6,243,936 B1 * 6/2001 Biesecker et al. ..... 206/499

* cited by examiner

*Primary Examiner*—Rinaldi I. Rada
*Assistant Examiner*—Paul Durand
(74) *Attorney, Agent, or Firm*—Kilpatrick Stockton LLP

(57) ABSTRACT

A package and method of packaging dangerous goods for transport, and in particular infectious substances, is disclosed. The package includes an outer collapsible container, an inner collapsible container, and means for suspending the inner collapsible container within the outer collapsible container. In a preferred embodiment, the outer collapsible container may be made of fiberboard and dimensioned for receipt and retention of the inner collapsible container, which may also be made of fiberboard. The inner container receives and maintains primary receptacles containing an infectious substance. If desired, the inner container may also receive and maintain a secondary container that receives the primary receptacles. The suspension means may comprise flap panels formed integrally with the outer container.

17 Claims, 4 Drawing Sheets

PACKAGE AND METHOD OF PACKAGING DANGEROUS GOODS FOR TRANSPORT

TECHNICAL FIELD

Figure 1:
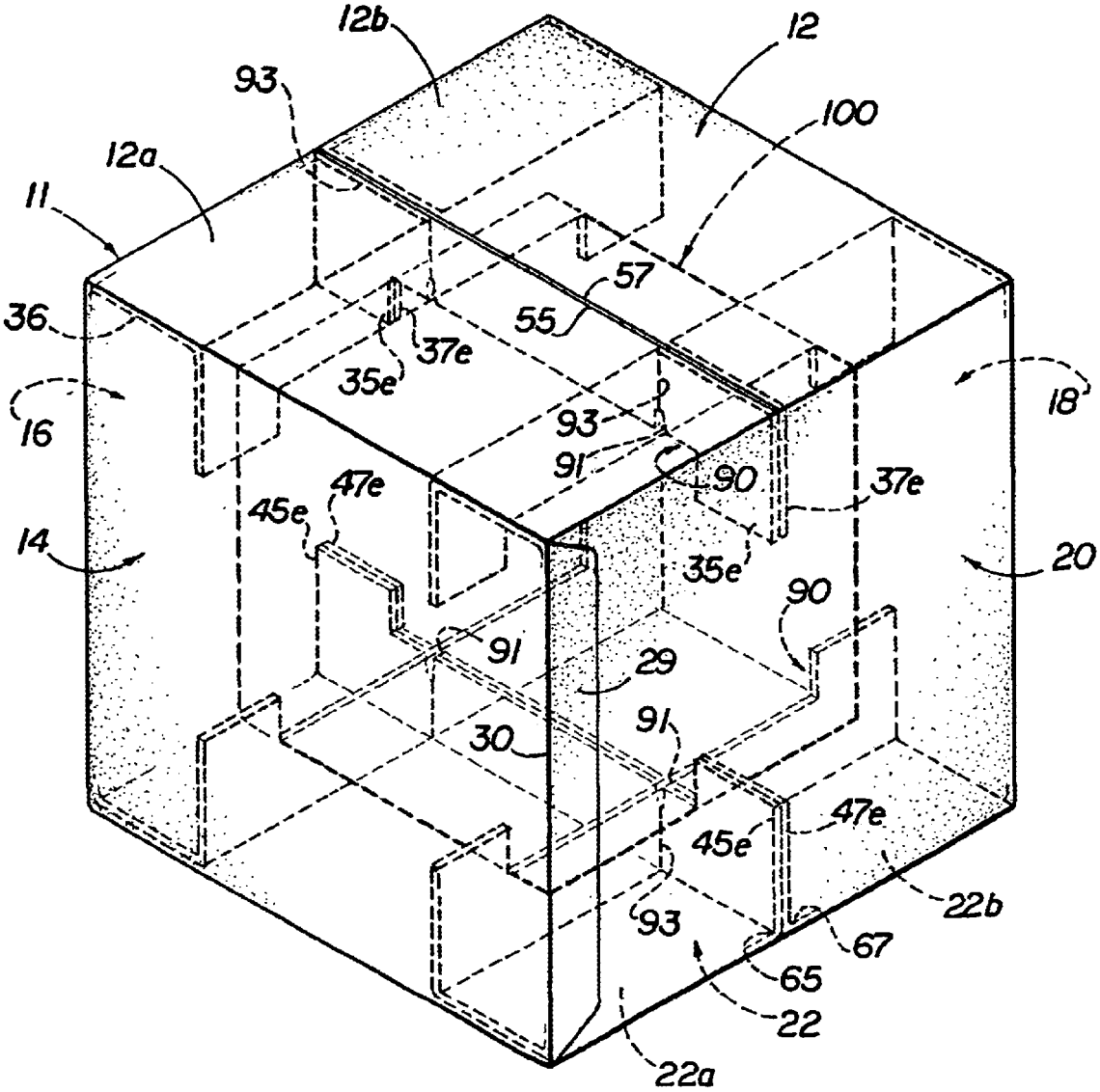

The present invention relates to the safe and efficient transportation of dangerous goods. More particularly, the present invention relates to an improved package and method of packaging dangerous goods, such as infectious substances for transport so as to protect users, handlers and the general public from exposure to such substances.

BACKGROUND

The handling and transport of dangerous goods is an increasingly complex and difficult task. The definition of a dangerous good may depend on the regulatory body consulted. Generally speaking, regulations tend to classify goods as dangerous based, primarily, on their respective inherently hazardous properties. For example, the Canadian Transportation of Dangerous Goods Regulations define "dangerous goods" as any product, substance or organism in any of nine classes of materials: explosive; gases; flammable and combustible liquids; flammable solids; oxidizing substances (such as organic peroxides); poisonous, toxic and infectious substances; radioactive materials; corrosives; and various and miscellaneous products, substances or organisms considered to be dangerous to life, health, property or the environment when transported. These regulations apply to the handling, shipping, transporting and importing of any such goods throughout Canada by any means of transportation.

Canada is not the only country or regulatory entity to be concerned with the transport of dangerous goods. The United States Hazardous Materials Regulations provided in 49 C.F.R. address the transportation of dangerous goods within the United States. The International Maritime Organization has issued the International Maritime Dangerous Goods Code, which is used in both Canada and the United States for international shipments by the marine mode. The International Civil Aviation Organization (ICAO") has issued regulations that, together with operator requirements, are included in the International Air Transport Association ("IATA") Dangerous Goods Regulations. Once again, both the United States and Canada use these regulations to govern the shipment of dangerous goods by air, both domestically and internationally. Yet further, the United Nations Committee of Experts has issued the United Nations Recommendations on the Transport of Dangerous Goods.

Enforcement of dangerous goods regulations has been an evolutionary process. Many of these regulations were not adopted until the 1980's. Even though IATA has regulated the international transport of dangerous goods since the 1970's, many businesses and shippers were not even aware of such regulations. As a result, the demand for dangerous goods packaging and packaging methods has increased as shippers and others have become increasingly aware of the regulations. Failure to comply with such regulations can, of course, be catastrophic. For example, in December of 1999, American Airlines' parent company, AMR, pled guilty to a felony charge and paid an $8 million fine for mishandling barrels filled with the chemical Dioxital. In 1996, an aircraft maintenance company failed to properly package oxygen canisters blamed for a cargo hold fire in a Valujet aircraft, causing the jet to crash in the Florida Everglades. Such high profile instances of failure to comply with such regulations have also greatly increased awareness.

Perhaps for similar reasons, the advent of infectious substance packaging and associated packaging methods has also been an evolutionary process. An early patent in this area is U.S. Pat. No. 4,882,893, entitled "Container for the Transport of Diagnostic Specimens." This patent discloses a method of packaging vials containing infectious substances or diagnostic specimens for purposes of transport. This method can be practiced by use of a package presently offered and sold by Saf-T-Pak, Inc. of Edmonton, Alberta, Canada under the designation "STP-100". This package includes a pressure vessel, or "secondary" container for receipt of vials containing an infectious substance," and a fiberboard outer container. This packaging relied upon cardboard (fiberboard) material to provide resistance to impact from dropping or puncture. This was the first package to be approved for use by a government regulatory entity, namely—Transport Canada.

A subsequent patent, U.S. Pat. No. 5,160,021, issued Nov. 3, 1992, and is entitled "Leak-proof Cylindrical Container for the Transport of Diagnostic Specimens or Dangerous Substances." This patent disclosed a leak-proof secondary container for packaging vials containing diagnostic specimens and the like. The disclosed container provided an open-topped cylinder having a radial groove adjacent its top end for retaining an o-ring gasket. A cap for the cylinder was also disclosed. The cap included a circular top wall and a skirt sized to slide over the top of the cylinder to sealingly engage an o-ring gasket.

As stated in both of these patents, the threat of user or handler infection due to inadvertent contact with blood that has been infected with the AIDS (Acquired Immune Deficiency Syndrome) virus (or some infectious substance) has also heightened awareness of the need for proper packages and methods of packaging such substances for transport. Using the shipment of blood as an example, the vial or "primary container" would be filled by a user (typically a technician or lab clerk) and inserted into a secondary container. Once that secondary container was properly sealed, an outer package is provided. The regulations typically require a water-tight primary container (a vial), a water-tight secondary packaging (a proper secondary container), absorbent material between the primary and secondary containers, and an outer container of sufficient strength to meet certain performance tests. The regulations do not provide or require a certain structure, such as, for example, a certain outer packaging. Instead, the regulations require that the package and/or method as a whole meet certain requirements. For example, the U.N. Recommendations require that the package pass a drop test of the entire package from nine (9) meters, a penetration test using a steel cylinder weighing 7 kilograms dropped from a point one (1) meter above the package, and a pressure test. These two patents therefore show two ways to address and comply with the regulations and/or recommendations. There are, of course, many more.

Such prior art packages have proven effective for transporting infectious substances and other dangerous goods. However, the weight and rigid construction of such prior art packaging components is a problem for shippers and users. Such packages are difficult to ship because they cannot be collapsed or "knocked-down" prior to use. The package therefore requires a significant space for both storage and shipment. Many prior art packages rely on cardboard (fiberboard) packing material to such cushion the secondary container. Such materials may be attached to or separate of the outer packaging, but nonetheless require additional space. Should the plastic secondary container become damaged, it must be repaired or replaced. Thus, there is a continuing need in the art for an improved package and to improve known methods of packaging infectious substances and other dangerous goods.

SUMMARY OF THE INVENTION

The present invention fills the above-described need in the prior art by providing an improved package and method of packaging infectious substances that includes collapsible packaging elements and avoids the use of additional packing material to meet the requisite performance tests. The present invention is also lighter than prior art packages and therefore more economical in use.

Generally described, the present invention comprises a first collapsible container, a second collapsible container, and means for suspending the second container within the first container.

Described somewhat more particularly, the present invention comprises an outer package including at least two surfaces, an inner package dimensioned to be received by the outer package, and means associated with the two surfaces of the outer package for suspending the inner box within the outer box. In a preferred embodiment, the means for suspension may comprise at least one scored flap panel integrally formed with one or more of the two surfaces of the outer package that, when properly manipulated, captures and suspends the inner package in such a way as to suspend the inner package within the outer package.

The present invention further includes a method of packaging an infectious substance or dangerous good. Generally described, a preferred method comprises causing the substance to be shipped to be confined within a first container, placing the first container within a second container, placing the second container within an inner package, and suspending the inner package within an outer package for shipment.

Thus, it is an object of the present invention to provide an improved package and method of packaging dangerous goods for transport that may be certified by a regulatory authority and thus passes the performance tests established by that regulatory authority.

It is a further object of the present invention to provide an improved package and method of packaging dangerous goods for transport that may be certified by a regulatory authority and thus passes the performance tests established by that regulatory authority.

It is a further object of the present invention to provide an improved package and method of packaging dangerous goods for transport that is capable of reducing the weight of shipment and shipping components.

It is a further object of the present invention to provide an improved package and method of packaging dangerous goods for transport that is economical and efficient to make, ship and use.

It is a further object of the present invention to provide an improved package and method of packaging dangerous goods that is particularly well suited for the transport of infectious substances.

It is a still further object of the present invention to provide an improved package and method of packaging dangerous goods that is particularly well suited for infectious substances and avoids the use of additional packaging material where possible.

These and other objects and advantages of the present invention will become apparent upon reading the following detailed description of preferred embodiments in conjunction with the drawings.

DETAILED DESCRIPTION

Referring now in more detail to the drawing, in which like numerals represent like parts throughout the several views, FIG. 1 shows an improved package 10 according to the present invention As illustrated, the package 10 provides an outer box 11 and an inner box 100. The inner box 100 is configured for and suspension within the outer box 11. FIG. 1 is a perspective view that shows both the outer box 11 and the inner box 100, as explained in greater detail below.

The outer box 11 defines six sides 12, 14, 16, 18, 20 and 22. Side 12 defines the top of the package 10. Sides 14, 16, 18 and 20 define the sides of the package 10. Side 22 defines the bottom of the package 10. It is to be noted that, in this embodiment of the invention, the top side 12 and the bottom side 22 each define two panels 12*a*, 12*b*, 22*a* and 22*b*, respectively. The utility of this construction will become apparent by reading the following.

The outer package 11 is preferably made of fiberboard, sometimes colloquially referred to as cardboard, or any other suitable material. While fiberboard is a preferred material, the outer package 11 may also be made of plastic, wood, fiberglass, steel or any other material suitable for the purposes set forth herein.

Figure 2:
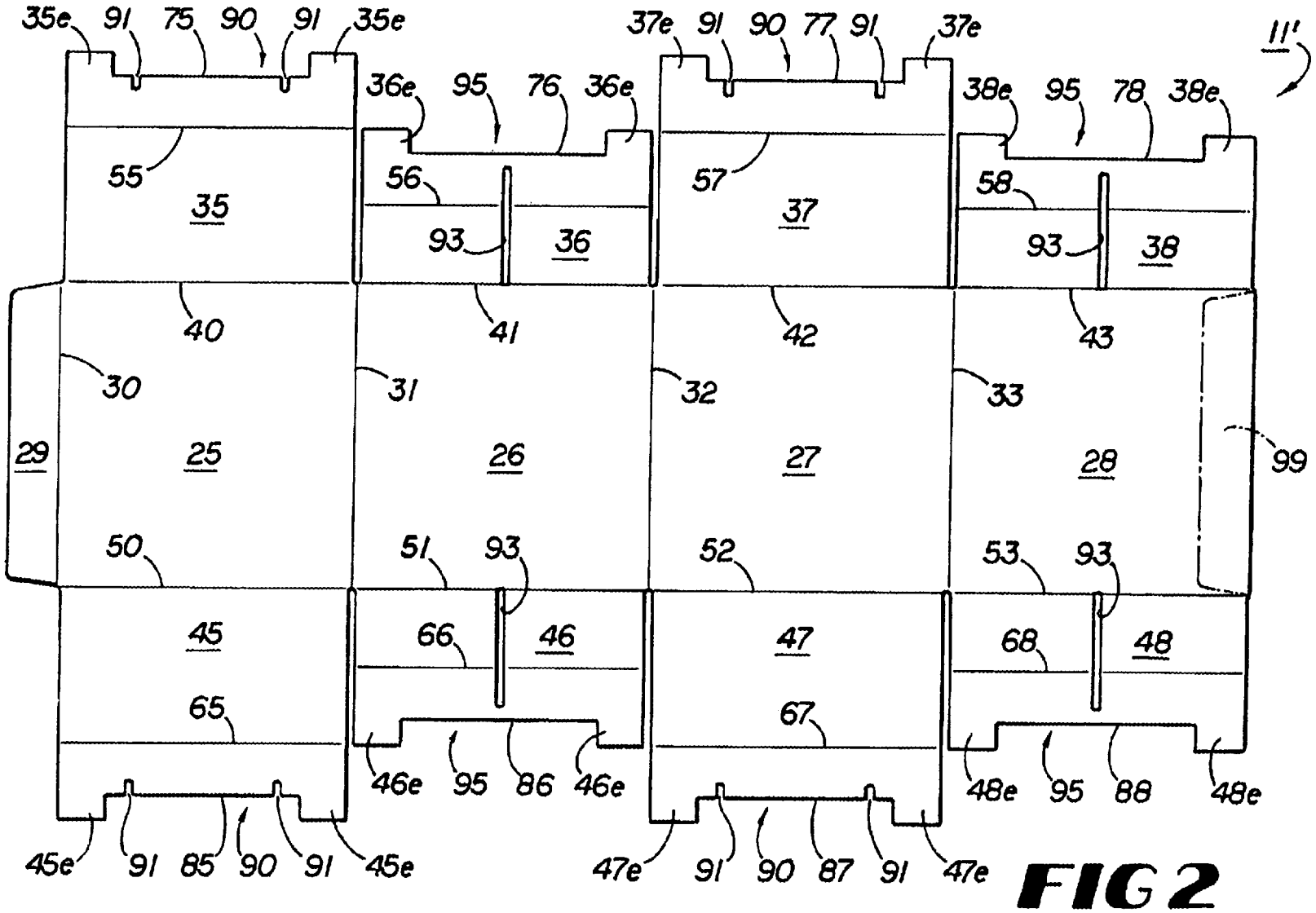

FIG. 2 shows a top plan view of a preferred blank 11' for production of the outer package 11. The blank 11' has four main panels 25, 26, 27 and 28 and a tab extension 29 foldably connected along score lines 30, 31, 32 and 33. The blank 11' further includes four top panels 35, 36 , 37 and 38 foldably connected to the main panels 25, 26, 27 and 28 along score lines 40, 41, 42 and 43, respectively. The blank 11' further includes four bottom panels 45, 46, 47 and 48 foldably connected to the main panels 25, 26, 27 and 28 along score lines 50, 51, 52 and 53. It is to be appreciated that when the outer package 11 is formed, the main panels 25, 26, 27 and 28 form the outer walls 14, 16, 18 and 20 of the outer package 11 shown in FIG. 1; the top panels 35 and 37 form the top walls 12*a* and 12*b* of the outer package 11 shown in FIG. 1; and the bottom panels 45 and 47 form the bottom walls 22*a* and 22*b* of the outer package 11 shown in FIG. 1.

Referring in greater detail to FIG. 2, it is shown that top panels 35, 36, 37 and 38 provide score lines 55, 56, 57 and 58, respectively. In like fashion, the bottom panels 45, 46, 47 and 48 provide score lines 65, 66, 67 and 68, respectively. Further, the edge portions of the top panels 35–38 and 45–48 are specially configured. More particularly, top panels 35, 36, 37 and 38 define respective flap edges 75, 76, 77 and 78 and bottom panels 45, 46, 47 and 48 define respective flap edges 85, 86, 87 and 88. It is to be noted that the edges 75, 77, and 85, 87 of flaps 35, 37 and 45, 47 respectively are mirror images one of the other. Similarly, top panels 76, 78 and 86, 88 of flaps 36, 38 and 46, 48, respectively, are also mirror images of one another.

Referring in greater detail to top panels 75, 77 and bottom panels 45, 47, it is seen that their respective edge portions each define cut-out sections 90 and two indented areas 91, the purpose of which will become apparent. Referring in greater detail to top panels 36, 38 and bottom panels 46, 48, it is seen that each include a rectangular cutout portion 93 and a cut-out section 95 at their respective edges 76, 78, 86 and 88.

It is to be understood that the outer box 11 is formed by connecting or gluing tab 29 to the edge portion (shown in phantom at 99). It is to be further understood that, once this operation is performed, main panels 25 opposes main panel 27, and main panel 26 opposes main panel. As shown below, when the panels 35, 45 and 37, 47 are brought together in a back to back fashion, the end portions thereof (designated 35*e*, 45*e* and 37*e*, 47*e*) mating panels 36, 46 and 38, 48 act to form a suspension mechanism that captures and retains the internal package 100.

Figure 3:
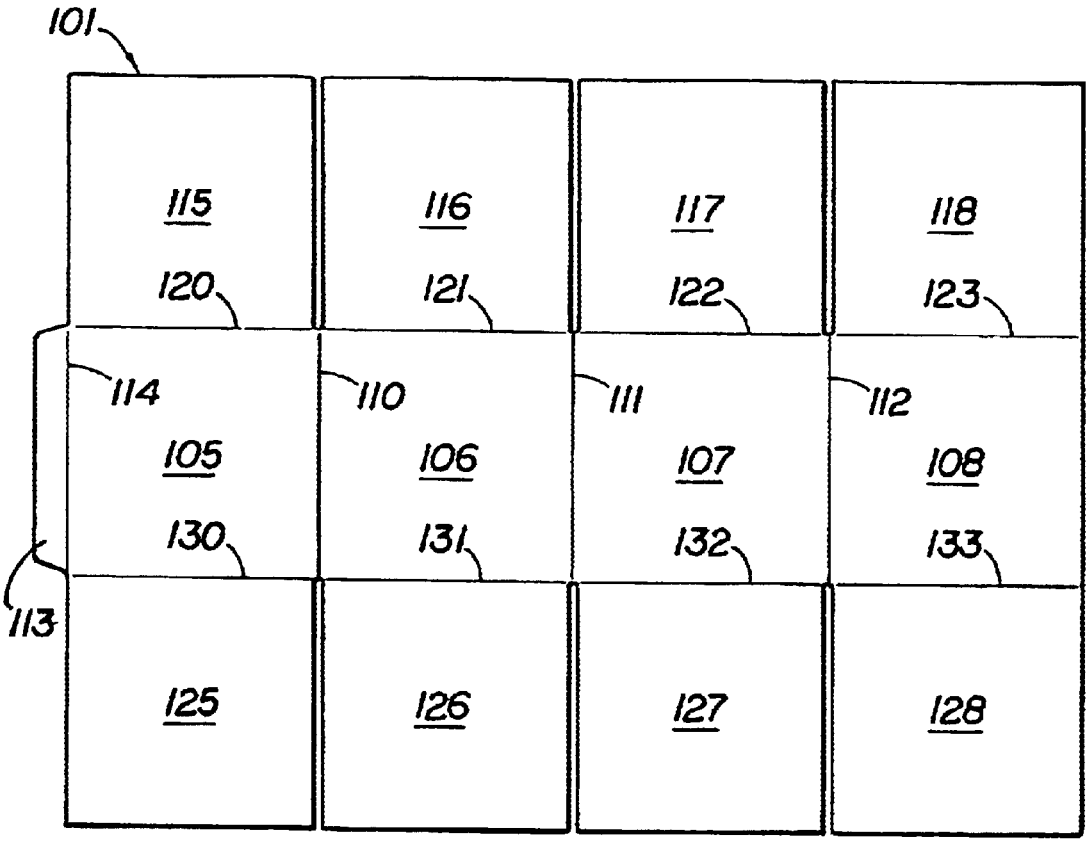
Figure 4:
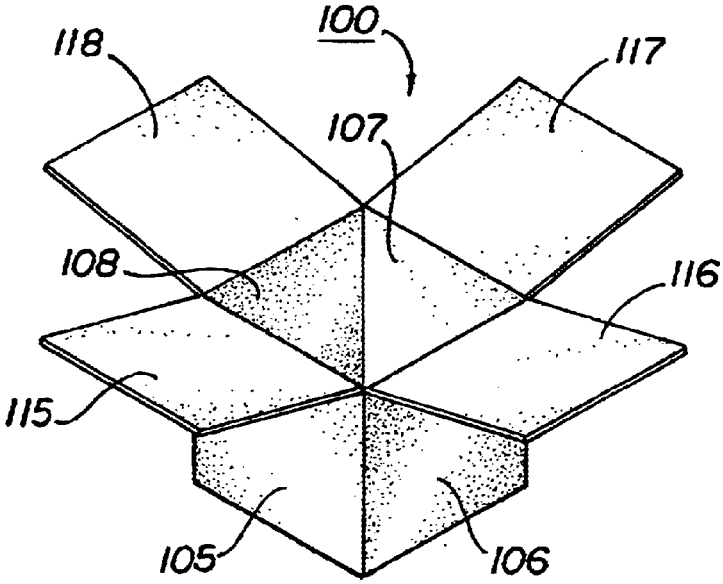

FIG. 3 shows a blank 101 that includes four main panels 105, 106, 107 and 108 foldably connected along score lines 110, 111 and 112. A tab extension 113 is foldably connected to main panel 105 along a score line 114. The blank 101 further includes four top panels 115, 116, 117 and 118 foldably connected to respective main panels 105, 106, 107 and 108 along respective score lines 120, 121, 122 and 123. Similarly, the blank 101 includes four bottom panels 125, 126, 127 and 128 foldably connected to respective main panels 105, 106, 107 and 108 along respective score lines 130, 131, 132 and 133. Those of ordinary skill in the art will appreciate that this blank 101 may readily be formed into an inner box as shown in FIG. 4. It is also to be understood that the inner box is to be of sufficient dimension to accept primary receptacles that are conventionally used to ship diagnostic specimens, hazardous goods and the like.

Figure 5:
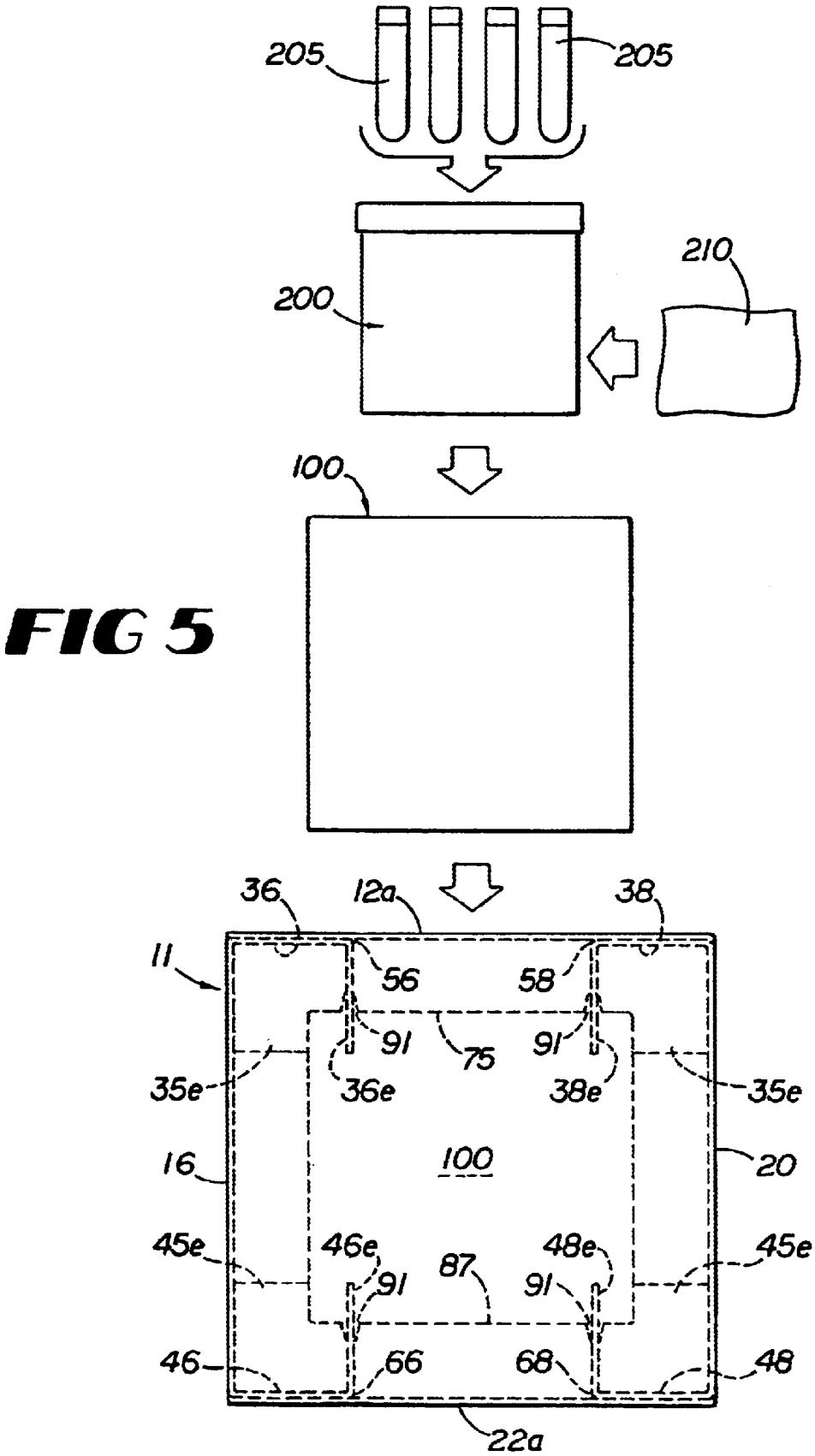

Use of the present invention defines a novel and improved method for shipment of diagnostic specimens, specifically, for infectious substances. As shown in FIG. 5, a primary receptacle or vial 205 is filled with blood or some other infectious substance. In accordance with accepted practice as required by regulation and suggested by recommendation, the vial or primary receptacle is substantially leakproof. Accordingly, the primary receptacles 205 may be a plastic screw cap vial (such as that presently offered by Corning Cryogenic or Fisher centrifuge tubes), a glass screw top container, a vacutainer, a blood bag (such as that presently offered by Medsep Corp.) or a petri dish. Of course, any other acceptable or suitable primary receptacle may be used.

The primary containers are then preferable wrapped, covered withn or placed in a shock resistant or shock absorbent material. A single primary receptacle may be so wrapper, covered or placed, or a plurality of primary receptacles may be wrapped, covered or placed together. Such a procedure is recommended, but may not be required by a particular recommendation. One may practice the present invention with or without wrapping, covering or placing the primary vial into any such material. The primary receptacle or receptacles are then placed into a secondary container 200, along with sufficient absorbent material 210 to absorb the entire volume of an infectious substance in the primary receptacles 205. Such an operation is conventionally required by regulation or suggested by a recommendation. The secondary container is preferably a pressure vessel that is capable of withstanding 95 kps for a sufficient time to demonstrate the appropriate or desired safety level. An appropriate time may range from a few seconds to as long as thirty (30) minutes depending on the specific recommendation or regulation being followed. A well suited secondary container is that shown and described in U.S. Pat. No. 4,882,893. Such a container (and others) is well-known to those of ordinary skill in the art and need not be disclosed further herein.

The secondary container is then placed within the inner box 100, and the top and, if necessary, bottom flaps 115–118 and 125–128 are closed in a usual manner. It is to be understood that the present invention may be practiced regardless of whether the inner box 100 is partially formed, or not formed at all, prior to placement of the secondary container into the inner box 100. It is only necessary that the secondary container 200 be inserted or otherwise placed into the inner box 100 and the box secured within the secondary container for shipment. Those of ordinary skill will appreciate that while the flaps 115–118 and 125–128 may be glued one to the other to insure the integrity of the inner box 100. However, due to the construction of the present invention, it is to be understood that the suspension means or flaps 35–38 and 45–48 will maintain the inner box 100 in a suitable position for shipment.

The inner box is then inserted or otherwise placed into the outer box 11. The outer box, relying primarily on the extensions 35*e*–38*e* and 45*e*–48*e* provides a mechanism for suspending the inner box 100 therein. It is of no relevance to the inventive concept whether the inner box 100 is placed within a partially formed outer box with or without a secondary container. It is only relevant that the secondary container is placed within the inner box 100, the inner box is secured contains the secondary container 200, and the inner box is then suspended within the outer box 11 for shipment.

Use of the preferred embodiment of the invention may include forming the outer package 11. To do so, the tab extension 29 is secured at position 99 on main panel 28. Of course, this operation may be performed by the manufacturer, as opposed to the user, since the package 11 may be "Knocked-down" once the tab extension 29 is glued or otherwise attached at position 99.

The package 11 may then be constructed by preferably forming the bottom of the package first. To do so, bottom flaps 46 and 48 are folded inward about score lines 51 and 53, respectively. Then, bottom flaps 45 and 47 are folded inwardly so that panels 45*a* and 47*e* are placed in a back-to-back fashion projecting upwardly in a substantially vertical plane, as shown in FIG. 1. Then, the flaps 46*e* and 48*e* are folded into a substantially horizontal plane about score lines 66 and 68, respectively. It will be appreciated that this operation is facilitated, in part, by the slots 93. In so doing, the flaps 45–48 create a suspension mechanism such that the projecting end of flaps 46 and 48 extend partially along the side of the inner box 100. Ends 86 and end 88 run along the entire length of opposing sides of the inner box 100. The ends 85 and 87 extend upwardly to engage the bottom of the inner box 100. Thus, it is to be understood that edges 85, 86, 87 and 88 contact and retain the inner box 100.

In like fashion, the top flaps 36 and 38 are first folded inwardly, then the other top flaps 35 and 37 are folded inwardly about score lines 40 and 42, respectively, to form a mirror image arrangement to that described above. It will be appreciated that folding flaps 35 and 37 inwardly forms the top surfaces 12*a* and 12*b* as shown in FIG. 1. Ends 75 and 77 of flaps 35 and 37 engage the top of inner box 100, and the projecting portions of said flap extend partially around the inner box. Thus, it is to be understood that ends 75, 76, 77 and 78 contact and retain the inner box 100.

Accordingly, the panels 35–38 and 45–48 comprise a device that suspends the inner box 100 within the outer box or package 11.

A package made in accordance with the foregoing preferred embodiments has been tested in accordance with Part 6, Chapter 6.3 of the United Nations Recommendations and the CGSB Standard 43.125-M99 Type 1A-High Integrity Packaging for Infectious Substances and the United States Regulations contained in 49 C.F.R. 178.6. Accordingly, a package made in accordance with the foregoing preferred embodiments has been subjected to a leak test, drop test, impact test, stacking test and vibration test. This package has received a "pass" designation for each such test.

Alternative embodiments of the present invention may call for the substitution of various materials. For example, the inner box 100 may be made of a material of different composition than that of the outer box 11. In a preferred embodiment both the inner box 100 and the outer box 11 are made of single-wall corrugated fiberboard. Nonetheless, the person of ordinary skill in the art will appreciate that any other suitable material or materials may be used.

The principles, preferred embodiments and modes of operation of the present invention have been described in detail, including the best mode thereof, in the foregoing specification. The invention is not to be construed as limited to the particular forms disclosed, because these are regarded as illustrative and not restrictive. Accordingly, variations and changes may be made by those skilled in the art without departing from the spirit or scope of the invention as set forth in the following claims.

What is claimed is:

1. A method for shipping infectious substances, comprising:

placing at least one primary receptacle within a secondary container;

placing said secondary container, including said primary receptacle, within an inner box; and suspending said inner box within an outer box by creating a suspension mechanism from flaps of the outer box, whereby said method of shipping minimizes leakage and breakage of said primary receptacles in shipment.

2. The method according to claim 1, further comprising covering the primary receptacle in shock resistant material.

3. The method according to claim 1, further comprising placing absorbent material sufficient to absorb the entire contents of the primary receptacle in the secondary container.

4. The method according to claim 1, wherein the secondary container is capable of withstanding pressure of 95 kps for up to thirty minutes.

5. The method according to claim 1, wherein the inner box is formed from a single blank.

6. The method according to claim 1, wherein the outer box is formed from a single blank.

7. The method according to claim 1, wherein the inner box and outer box are collapsible.

8. The method according to claim 1, further comprising passing the leak test, drop test, impacting test, stacking test, and vibration test.

9. A method of packaging infectious substances for shipment comprising:

placing the infectious substance within a primary receptacle;

placing at least one primary receptacle and absorbent material sufficient to absorb the entire contents of the primary receptacle within a secondary container;

placing the secondary container and primary receptacle within an inner box formed from a single blank;

placing the inner box, secondary container and primary receptacle in an outer box formed from a single blank; and creating a suspension mechanism from flaps integrally attached to the outer box which maintains the inner box in a suitable position for shipment, whereby the packaging is well suited for shipping infectious substances by minimizing breakage during shipping.

10. The method according to claim 9, further comprising surrounding the primary receptacle in shock absorbent material.

11. The method according to claim 9, wherein the inner box and outer box are collapsible.

12. The method according to claim 9, wherein the packaging passes the leak test, drop test, impacting test, stacking test, and vibration test.

13. A method of packaging dangerous goods for shipment comprising:

placing the infectious substance within a primary receptacle;

placing at least one primary receptacle and absorbent material sufficient to absorb the entire contents of the primary receptacle within a secondary container;

placing the secondary container and primary receptacle within an inner box;

placing the inner box, secondary container and primary receptacle in an outer box; and creating a suspension mechanism from flaps integrally attached to the outer box which maintains the inner box in a suitable position for shipment, whereby the packaging is well suited for shipping infectious substances by minimizing breakage during shipping.

14. The method according to claim 13, wherein the inner box is formed from a single blank and the outer box is formed from a single blank.

15. The method according to claim 13, further comprising placing the primary receptacle in shock resistant material.

16. The method according to claim 13, wherein the inner box and outer box are collapsible.

17. The method according to claim 13, wherein the packaging passes the leak test, drop test, impacting test, stacking test, and vibration test.

* * * * *

UNITED STATES PATENT AND TRADEMARK OFFICE

CERTIFICATE OF CORRECTION

PATENT NO. : 6,634,156 B1
DATED : October 21, 2003
INVENTOR(S) : Arthur G. Rutledge It is certified that error appears in the above-identified patent and that said Letters Patent is hereby corrected as shown below:

Column 5,
Line 38, delete “wrapper” and substitute -- wrapped --

Signed and Sealed this

Twentieth Day of July, 2004

JON W. DUDAS
*Acting Director of the United States Patent and Trademark Office*